United States Patent [19]

Aboelfotoh

[11] 4,429,303

[45] Jan. 31, 1984

[54] COLOR PLASMA DISPLAY DEVICE

[75] Inventor: Mohamed O. Aboelfotoh, Poughkeepsie, N.Y.

[73] Assignee: International Business Machines Corporation, Armonk, N.Y.

[21] Appl. No.: 219,156

[22] Filed: Dec. 22, 1980

[51] Int. Cl.[3] ..... G09G 3/28

[52] U.S. Cl. ..... 340/701; 313/485; 313/489; 340/772; 340/718

[58] Field of Search ..... 313/484, 485, 489; 340/772, 718, 719, 701, 703, 704

[56] References Cited

U.S. PATENT DOCUMENTS

| | | | |
|---|---|---|---|
| 3,890,530 | 7/1975 | Hammer et al. | 313/489 |
| 3,986,074 | 10/1976 | Watanabe et al. | 313/489 |
| 4,048,533 | 9/1977 | Hinson et al. | 313/489 |
| 4,112,332 | 9/1978 | Veith et al. | 340/772 |
| 4,147,958 | 3/1979 | Ahearn et al. | 340/772 |
| 4,162,427 | 7/1979 | Kamegaya et al. | 340/772 |

*Primary Examiner*—Marshall M. Curtis
*Attorney, Agent, or Firm*—Joseph J. Connerton

[57] ABSTRACT

A multicolor gaseous discharge display device utilizes electroluminescent techniques as a plasma environment. A layer of electroluminescent phosphor material is used as the dielectric layer overlying the conductor electrodes in an A.C. plasma device. In one embodiment for generating a two color display, only one of the dielectric layers uses an electroluminescent phosphor for a two color display. In a second embodiment, both dielectric layers use different electroluminescent material for a three color display. A layer of n-type semiconductor material is required between the conductor electrodes and the phosphor dielectric to reduce the electroluminescent voltage threshold, while a refractory layer is used to protect the phosphor against ion bombardment during discharge of said device.

8 Claims, 6 Drawing Figures

COLOR PLASMA DISPLAY DEVICE

CROSS REFERENCE TO RELATED APPLICATIONS

U.S. application Ser. No. 372,384, "Method and Apparatus for Gas Display Panel" filed by Tony N. Criscimagna and Albert O. Piston, June 21, 1973.

BACKGROUND OF THE INVENTION

The present invention relates to A.C. plasma display panels and in particular to such panels for producing a multicolor display.

Plasma or gaseous discharge display and/or storage devices have certain desirable characteristics such as small size, thin flat display package, relatively low power requirements and inherent memory capability which render them particularly suitable for display. One example of such known gaseous discharge devices is disclosed in U.S. Pat. No. 3,559,190, "Gaseous Display and Memory Apparatus," patented Jan. 26, 1971 by Donald L. Bitzer et al and assigned to the University of Illinois. Such panels, designated A.C. plasma panels, may include an inner layer of physically isolated cells or alternatively comprise an open panel configuration of electrically isolated but not physically isolated gas cells. In the open panel configuration which represents the preferred embodiment of the present invention, a pair of glass plates having dielectrically coated conductor arrays formed thereon are sealed with the conductor arrays disposed in substantially orthogonal relationship. When appropriate drive signals are applied to selected conductors, the signals are capacitively coupled to the gas through the dielectric. When these signals exceed the breakdown voltage of the gwas, the gas discharges in the selected area, and the resulting charge particles, ions and electrons, are attracted to the wall having a potential opposite the polarity of the particle. This wall charge potential opposes the drive signal which produces and maintains the discharge, rapidly extinguishing the discharge and assisting the breakdown in the next alteration. Each discharge produces light emission from the selected cell or cells, and by operating at a relatively high frequency in the order of 30–50 kilocycles, a flicker-free display is provided. In general, the color of the emitted light is characteristic of or determined by the gas or mixture of gases employed in the gaseous discharge device. After the initial breakdown, the wall charge condition is maintained in selected cells by application of a lower potential control signal designated the sustain signal which, combined with the wall charge, causes the selected cells to be reignited and extinguished continuously at the applied frequency to maintain a continuous display.

In order to obtain a multicolor display using A.C. gas discharge display panels, the prior art has proposed using photoluminescent phosphors such as $Zn_2SiO_4$:Mn, $YVO_4$:Eu and $CaWO_4$:Pb incorporated into the panels. The phosphors are applied over the surface of the dielectric layer overlying the conductor arrays in donut or bar geometry and are excited by the ultra-violet radiation generated in the negative glow of a xenon, helium-xenon or helium-neon-xenon discharge.

Prior art multicolor A.C. plasma panels with open cell configuration which use photoluminescent phosphors include certain disadvantages such as optical cross talk between adjacent cells caused by line-of-sight excitation. Additionally, multiple reflection of ultraviolet radiation emanating from a cell in the "on" state seriously degrades on-off luminance. Another disadvantage of such prior art panels is that the luminous efficiency of the phosphor rapidly decreases due to degradation of the phosphor resulting from ion bombardment during the discharge.

The prior art has also taught certain methods for reducing optical cross talk and for protecting the phosphor from damage by the discharge in multicolor A.C. gas discharge display panels. One such method of reducing optical cross talk comprises the use of optical baffles to reduce line-of-sight excitation. Another method of reducing optical cross talk comprises using black ultraviolet-radiation-absorbing materials applied over the dielectric surface in selected areas surrounding the phosphors to reduce multiple reflection of ultraviolet radiation. However, suppression of optical cross talk achieved by these methods has not proven satisfactory.

In order to avoid degradation of the phosphor resulting from ion bombardment in a gaseous discharge device, a refractory material having a high binding energy and a high transmittance of ultraviolet radiation such as $SiO_2$ or $Al_2O_3$ is utilized to protect the phosphor. However, ion bombardment of $SiO_2$ and $Al_2O_3$ during A.C. operation substantially decreases the transmittance of ultraviolet radiation, resulting in a corresponding decrease in the luminance of the phosphor, thereby limiting the useful life of the device.

SUMMARY OF THE INVENTION

Accordingly, it is an object of the present invention to provide A.C. plasma display devices which are capable of producing a multicolor display with substantially improved optical and electrical performance. Briefly, a layer of electroluminescent phosphor material is used as the dielectric layer overlying the conducting electrodes in an A.C. gaseous discharge display panel. Electroluminescence is the term applied to the light emission when an electric field is applied across a layer of electroluminescent phosphor. The electroluminescent dielectric layer is isolated from direct contact with the discharge gas by one or more dielectric layers having high dielectric constant, good optical transparency and relatively high breakdown strength, with the gas-contacting layer being made of a refractory material having high binding energy and high secondary electron emission characteristics such as magnesium oxide. In order to substantially reduce the threshold voltage for electroluminescence below the voltage appearing across the electroluminescent dielectric layer, i.e., between the surface of the dielectric and the underlying conducting electrode during A.C. operation, a layer of n-type semiconducting material having a high impurity concentration and overlying only the conducting electrodes, is interposed between the conducting electrodes and the phosphor dielectric layer. In this way, a sufficiently high density of carriers (electrons) will be injected into the phosphor dielectric layer from the n-type semi-conducting layer when a charge is established on the surface of the gas-contacting dielectric layer and a high electric field is built up in the phosphor dielectric layer during A.C. operation. This will result in a substantial reduction in the threshold voltage for electro-luminescence.

The color of the light emitted by the electroluminescent layer will be that characteristic of the electroluminescent phosphor which is so chosen that different discharge cells are prepared with phosphor dielectrics emitting different characteristic colors. Since the intensities of the light emitted by the electroluminescent phosphor and by the gas discharge are both frequency dependent, the color of different discharge cells can be controlled by varying the frequency of the sustaining voltage.

The foregoing and other objects, features and advantages of the invention will be apparent from the following more particular description of preferred embodiments of the invention, as illustrated in the accompanying drawings.

DETAILED DESCRIPTION OF THE INVENTION

Figure 1:
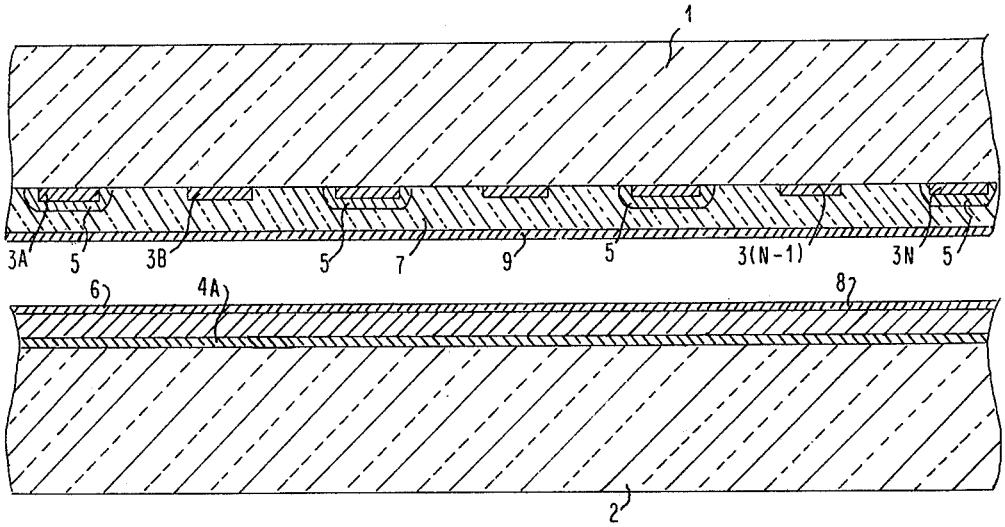
FIG. 1 illustrates a sectional view of a portion of a gaseous discharge display panel constructed according to the present invention.

Referring now to the drawings and more particularly to FIG. 1 thereof, column and row conductor arrays 3 and 4 are deposited on plate glass substrates 1 and 2, respectively. A layer 5 of an n-type semiconducting material, such as tin, tellurium, tin telluride or silicon doped gallium arsenide having a high impurity concentration of $10^{17}$ per $cm^3$ is then deposited directly over alternate conductors in the column conductor array 3. Formed over the column conductor array 3 is a dielectric layer 7 which may comprise an electro-luminescent phosphor such as rare-earth doped zinc selenide, zinc sulphide or cadmium sulphide. Row conductor array 4 is isolated from the discharge gas by a dielectric layer 6 which may comprise a solder glass such as lead-borosilicate glass containing a high percentage of lead oxide. In order to protect the surface of dielectric members 6 and 7 against degradation resulting from ion bombardment while providing lower operating voltages, dielectric layers 6 and 7 are overcoated with layers 8 and 9 respectively of a refractory high secondary emissive material such as magnesium oxide.

In fabricating the device shown in FIG. 1, column and row conductor arrays 3 and 4 may be formed on associated plate glass substrates 1 and 2 by a number of well-known processes such as photoetching, vacuum deposition, stencil screening, etc. Transparent, semi-transparent or opaque conductive material such as tin oxide, gold or aluminum can be used to form the conductor arrays, and should have a resistance less than 3000 ohms per line. Alternatively, the column and row conductor arrays 3 and 4 may be wires or filaments of gold, silver or aluminum or any other conductive metal or material. For example, 1 mil wire filaments are commercially available and may be used in the invention. However, formed in situ conductor arrays are preferred, since they may be more easily and more uniformly deposited on and adhered to the substrates 1 and 2. An important criteria in selection of a conductor material is that it be impervious to attack or otherwise protectable from attack by the dielectric glass during fabrication.

The n-type semiconducting surface 5 is formed directly over every other conductor in column conductor array 3 by co-evaporation of gallium, arsenic and an n-type dopant, such as tin, tellurium, tin telluride or silicon, using separate sources. The n-type semiconducting surface 5 is formed over the conductor or a cell-by-cell definition; however, it will be appreciated that it could be also applied over the entire length of the conductor as a ribbon. In a preferred embodiment according to the present invention, the semiconducting layer is 1,000–20,000 Angstroms thick and has a donor impurity concentration of about $10^{17}$ per $cm^3$.

The electroluminescent dielectric layer 7 is formed over column conductor array 3 by co-evaporation of zinc selenide, zinc sulphide or cadmium sulphide and terbium fluoride using separate sources. The electroluminescent phosphor material may comprise between 1% and 5% terbium fluoride, while the layer in the preferred embodiment is 1,000–10,000 Angstroms thick. Dielectric layer 6 is preferably formed in situ directly over row conductor array 4 of an inorganic material having an expansion coefficient closely related to that of the substrate member 2. One preferred dielectric material, as previously indicated, is lead-borosilicate solder glass, a material containing a high percentage of lead oxide, while the dielectric layer 6 is usually between 1 and 2 mils thick. The dielectric layer surface must be smooth, have a breakdown voltage of about 1,000 volts and be electrically homogeneous on a microscopic scale, i.e., must be free from cracks, bubbles, crystals, surface films or any impurity or imperfection. Dielectric layers 6 and 7 are then overcoated with layers 8 and 9 respectively of magnesium oxide which may be between 500–5,000 Angstroms in thickness. The preferred spacing between surfaces of the dielectric layers is about 4 to 6 mils, with conductor arrays 3 and 4 having center-to-center spacing of about 20 mils using 3–6 mil wide conductors which may be typically 5,000–20,000 Angstroms in thickness.

Figure 2:
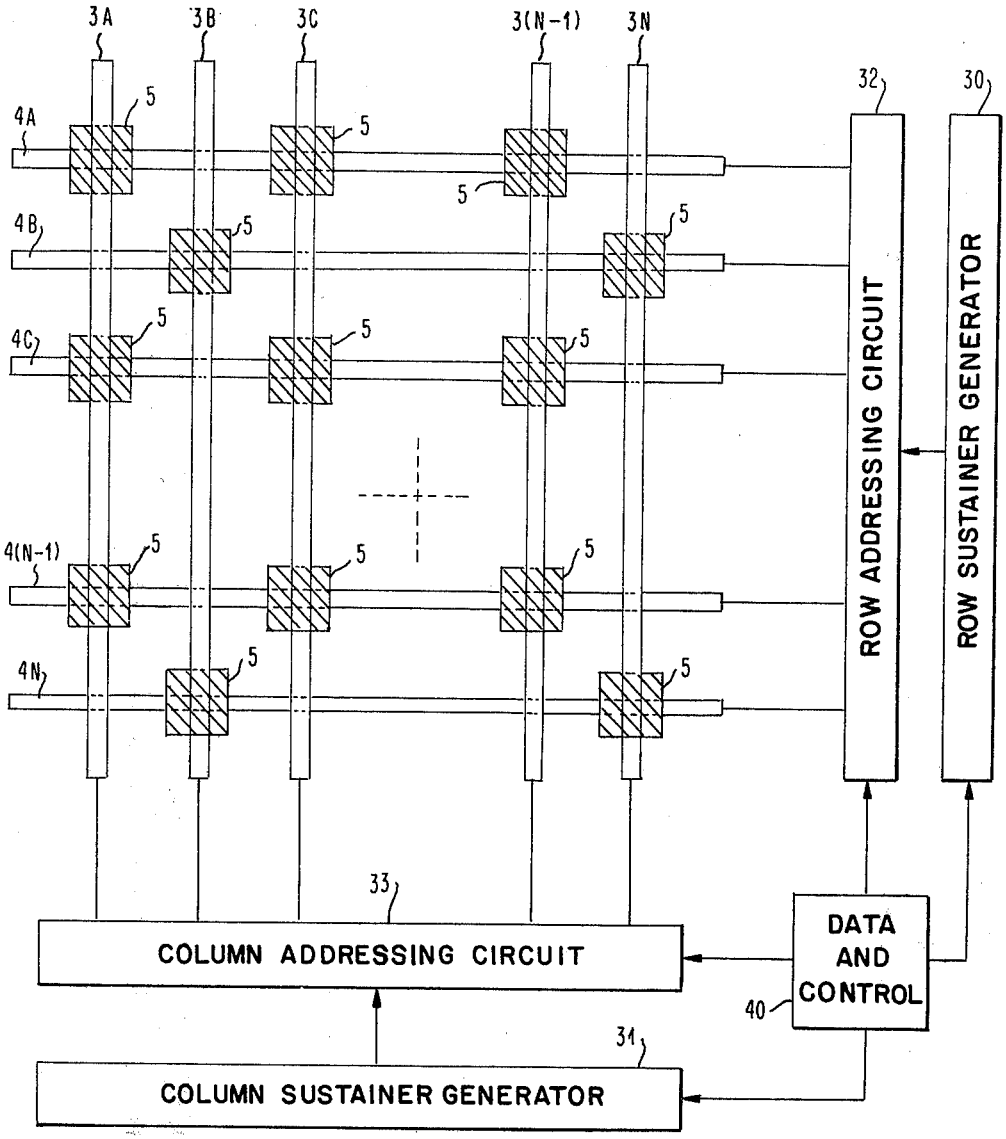
FIGS. 2 and 3 illustrate an operating system utilizing the plasma display panel, shown in FIG. 1.
Figure 3:
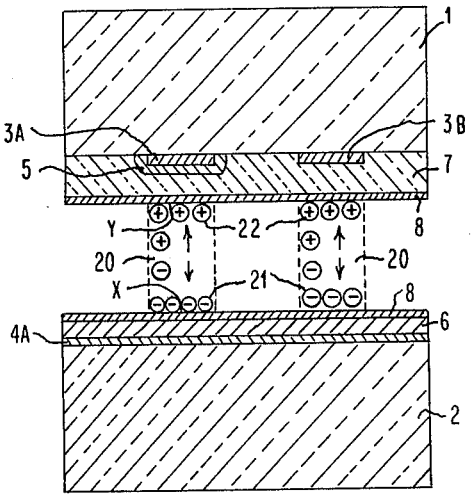

FIGS. 2 and 3 illustrate the basic operation of the gaseous discharge display panel of FIG. 1 described above. Elemental gas volumes 20 (FIG. 3) defined by, for example, the intersection of row conductor 4A with column conductors 3A and 3B, are selectively ionized during a write operation by applying to the associated conductors coincident write and sustain signals having a magnitude sufficient when algebraically combined to produce a light generating discharge. The sustain potential is applied to, for example, row conductor 4A and column conductor 3A by the row sustain generator 30 and the column sustain generator 31, while the write pulse potentials are applied to row conductor 4A and column conductor 3A by the row addressing circuit 32 and the column addressing circuit 33 respectively in response to signals from data source and control circuit 40, which also controls sustain generators 30 and 31. In the preferred embodiment herein described, the control potentials for write, sustain and erase operations are square wave pulse signals of the type described in aforereferenced co-pending application Ser. No. 372,384. As shown in FIG. 3, since row conductor 4A is positive, electrons 21 have collected on and attracted to an elemental areas X of the surface of dielectric member 6 substantially corresponding to the area of elemental gas volumes 20, while the less mobile positive ions 22 are beginning to collect on the opposed elemental areas Y of dielectric member 7 which at that time is negative. As these charges build up, they constitute a charge potential opposed to the voltage applied to row and column conductors 4A and 3A and serve to terminate the discharge in elemental gas volume 20 for the remainder of a half-cycle.

After the initial discharge of elemental gas volumes 20, write signals are removed so that only the sustain voltage from row and column sustain generators 30 and 31 is applied to row and column conductors 4A–4N and 3A–3N respectively. Due to the charge storage (e.g. the memory) at the opposed elemental areas X and Y, the elemental gas volume 20 will discharge during each subsequent half-cycle of sustain voltage, to again produce a momentary pulse of light. Any of the selected "on" elemental gas volumes 20 may be turned "off," termed an erase operation, by application to selected "on" elemental volumes voltage pulses from row and column addressing circuits 32 and 33, which neutralize the charges stored at the pairs of opposed elemental areas so that the sustain voltage is not adequate to maintain the discharge. It should be noted that the details of the data source, control circuit, row and column sustain generators and row and column addressing circuits do not constitute a part of the present invention and, are unnecessary for an understanding thereof. Further, the circuitry necessary to operate the A.C. gaseous discharge display panel according to the present invention is considered well-known to those skilled in the art.

At the elemental gas volume 20 defined by the intersection of column conductor 3A with row conductor 4A, a sufficiently high density of carriers (electrons) is injected into the phosphor dielectric layer 7 from the n-type semiconducting layer 5 when the elemental gas volume is in the discharge state, i.e., a charge is established on the gas-contacting dielectric layer 9 and a high electric field is built up in the phosphor dielectric layer 7. This causes the threshold voltage for electroluminescence to reduce substantially below the voltage appearing across the phosphor dielectric layer 7, between the surface of dielectric layer 9 and the underlying column conductor 3A, during A.C. operation. Since the intensity of the green light emitted by the electroluminescent phosphor is substantially higher than that of the light generated by the neon-argon discharge glow of yellow-red color, the green color is dominant. At the elemental gas volume 20 defined by column and row conductors 3B and 4A, the voltage appearing across the phosphor dielectric layer 7, between the surface of dielectric layer 9 and the underlying column conductor 3B, during A.C. operation, is substantially lower than the threshold voltage for electroluminescence since no n-type semiconducting layer is interposed between column conductor 3B and the phosphor dielectric layer 7. As a result, the yellow-red color of the light emitted by the neon-argon discharge is dominant. Thus the device shown in FIG. 1 is capable of producing at least two different colors which may be considered as primary colors, enabling other colors to be obtained by the additive mixing of the colors characteristic of the gas discharge and of the electroluminescent phosphor.

Figure 4:
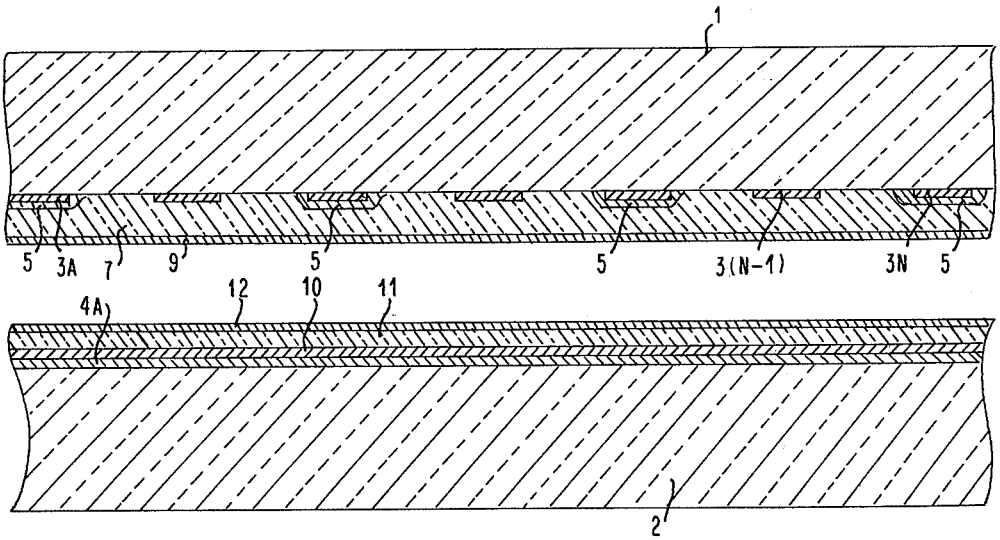
FIG. 4 is a sectional view of an alternative embodiment of the gaseous discharge display panel illustrated in FIG. 1.

FIG. 4 illustrates an alternative embodiment of the gaseous discharge display panel according to the present invention. In FIG. 1, the n-type semiconducting layer and the electroluminescent phosphor layer are shown formed only over plate glass substrate 1. In FIG. 4, a layer 10 of an n-type semiconducting material, such as tin, tellurium, tin telluride or silicon doped gallium arsenide, having a high impurity concentration of $10^{17}$ per $cm^3$, is deposited also directly over alternate conductors in row conductor array 4. Formed over the row conductor array 4 and semiconducting material 10 is the dielectric layer 11, which may comprise an electroluminescent phosphor such as zinc selenide, zinc sulphide or cadmium sulphide doped with both terbium fluoride and manganese. The electroluminescent dielectric layer 11 is then overcoated with a layer 12 of a refractory high secondary emissive material such as magnesium oxide.

In fabricating the gaseous discharge display panel shown in FIG. 4 according to the present invention, column and row conductor arrays 3 and 4 are formed on plate glass substrates 1 and 2, respectively. The n-type semiconducting layers 5 and 10 are then deposited directly over alternate conductors in the column and row conductor arrays 3 and 4, respectively, on a cell-by-cell definition, as shown in FIG. 4. Layers 5 and 10 are 1,000–20,000 Angstroms thick and preferably have a donor impurity concentration of about $10^{17}$ per $cm^3$. Formed over the column and row conductor arrays 3 and 4 are the electroluminescent dielectric layers 7 and 11, respectively. Dielectric layer 7 is formed of a phosphor material such as terbium fluoride doped zinc selenide, zinc sulphide or cadmium sulphide which may comprise between 1% and 5% terbium fluoride, and the layer is 1,000–10,000 Angstroms thick. Dielectric layer 11 is formed of a phosphor material such as zinc selenide, zinc sulphide or cadmium sulphide doped with both terbium fluoride and manganese which may comprise between 1% and 5% terbium fluoride and between 1% and 5% manganese, and is also 1,000–10,000 Angstroms thick. The electroluminescent dielectric layers 7 and 11 are isolated from the gas discharge by layers 9 and 12 respectively of a refractory high secondary emissive material such as magnesium oxide which may be 500–5,000 Angstroms in thickness.

Figure 5:
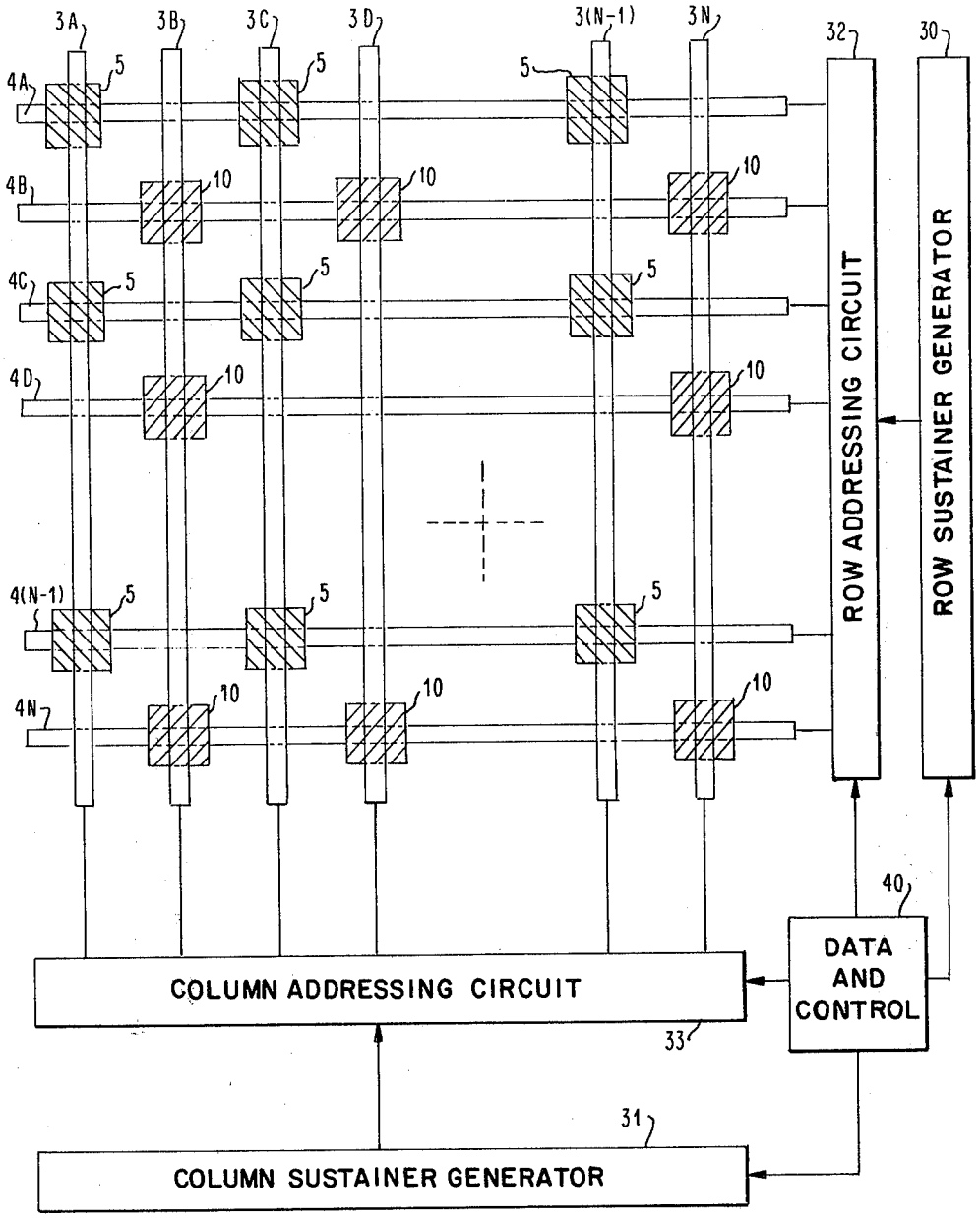
FIG. 5 illustrates an operating system utilizing the gaseous discharge display panel shown in FIG. 4.

FIG. 5 illustrates a multicolor plasma display system for operating the gaseous discharge display panel shown in FIG. 4 and described above. At the elemental gas volume 20 defined by column conductor 3A with row conductor 4A (FIG. 3) a sufficiently high density of carriers (electrons) is injected into the phosphor dielectric layer 7 from the n-type semiconducting layer 5 when the elemental gas volume is in the discharge state, thus causing the threshold voltage for electroluminescence to drop substantially below the voltage appearing across the phosphor dielectric layer 7 during A.C. operation. The voltage appearing across the phosphor dielectric layer 11, between the surface of dielectric layer 12 and the underlying row conductor 4A, during A.C. operation is substantially lower than the threshold voltage for electroluminescence, since no n-type semiconducting layer is interposed between row conductor 4A and the phosphor dielectric layer 11 at the intersection defined by column conductor 3A with row conductor 4A. As previously described, since the intensity of the light emitted by the phosphor dielectric layer 7 which emits light of green color is substantially higher than that of the light generated in the negative glow of, for example, an argon-mercury discharge which emits light of blue color, the green color is dominant. At the elemental gas volume defined by column conductor 3B with row conductor 4A, the voltage appearing across the phosphor dielectric layers 7 and 11 during A.C. operation is substantially lower than the threshold voltage for electroluminescence, since no n-type semiconducting layer is interposed between column conductor 3B and the phosphor dielectric layer 7 and between row conductor 4A and the phosphor dielectric layer 11. As a result, the blue color of the light emitted by the argon-mercury gas discharge is dominant. At the elemental gas volume defined by column conductor 3B with row conductor 4B, a sufficiently high density of carriers (electrons) is injected into the phosphor dielectric layer 11 from the n-type semiconducting layer 10 when the elemental gas volume is in the discharge state, thus causing the threshold voltage for electro-luminescence to reduce substantially below the voltage appearing across the phosphor dielectric layer 11 during A.C. operation. The voltage appearing across the phosphor dielectric layer 7 is substantially lower than the threshold voltage for electroluminescence, since no n-type semi-conducting layer is interposed between the column conductor 3B and the phosphor dielectric layer 7. Since the intensity of the red light emitted by the phosphor dielectric layer 11 is substantially higher than that of the blue light generated in the negative glow of the argon-mercury discharge, the red color is dominant. Thus, the device shown in FIG. 4 is capable of displaying at least three different primary colors, which enable other colors to be obtained by the permutations of the colors characteristic of the gas discharge and of the electroluminescent phosphors. The intensities of light emitted by the gas discharge and by the electroluminescent phosphors are both frequency dependent, and hence the colors which result from the mixing of said characteristic colors can be further controlled by varying the frequency of the sustain voltage.

An advantage of the multicolor gaseous discharge display panels shown in FIGS. 1 and 4 is the elimination of optical cross talk between adjacent discharge cells, thus eliminating the necessity of optical barriers between adjacent discharge cells which are commonly provided in known multicolor gaseous discharge display panels. Another advantage of the multicolor gaseous discharge display panels according to the present invention over prior art panels is the significant improvement in the life of the phosphor and hence in the usable life of the device.

Figure 6:
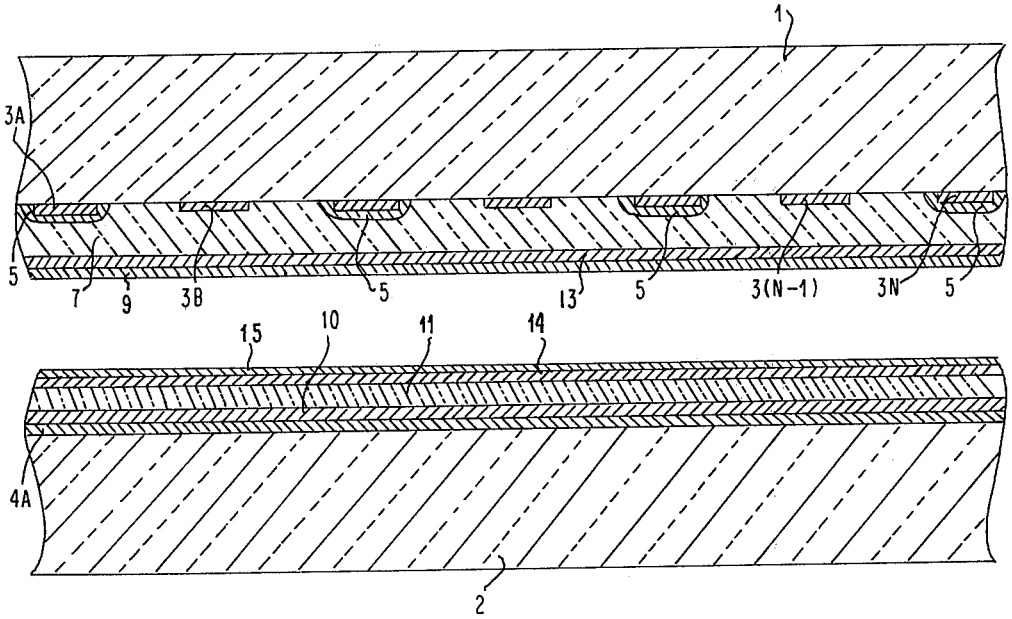
FIG. 6 is a sectional view of another embodiment of a multicolor gaseous discharge display panel.

FIG. 6 illustrates still another embodiment of the multicolor gaseous discharge display panel according to the present invention. In FIG. 4, the phosphor dielectric layers 7 and 11 are shown isolated from the gas discharge by insulating layers 9 and 15 respectively. In FIG. 6, the electroluminescent phosphor layers 7 and 11 are isolated from the gas discharge by more than one insulating layer, having high dielectric constant, good transparency and relatively high breakdown strength, with the gas-contacting layer again made of a refractory high secondary electron emissive material such as magnesium oxide.

In fabricating the device shown in FIG. 6 according to the present invention, column and row conductor arrays 3 and 4 are formed on plate glass substrates 1 and 2, respectively. N-type semiconducting layers 5 and 10 are then deposited directly over alternate conductors in the column and row conductor arrays 3 and 4, respectively, on a cell-by-cell definition in the same manner as in FIGS. 4 and 5. Formed over the column and row conductor arays 3 and 4 are the electroluminescent phosphor layers 7 and 11, respectively. Layers 13 and 14 made of a ferroelectric insulating material such as lead titanate which may be 1,000–10,000 Angstroms thick, are applied over the entire surface of the electroluminescent phosphor layers 7 and 11 and are then overcoated with insulating layers 9 and 15, respectively, of a refractory high secondary electron emissive material such as magnesium oxide, which may be 500–5,000 Angstroms thick. The use of layers made of a ferroelectric insulating material such as lead titanate, as shown in FIG. 6, results in a further reduction in the threshold voltage for electroluminescence and in a substantial improvement in the luminous efficiency of the phosphor.

While the invention has been particularly shown and described with reference to preferred embodiments thereof, it will be understood by those skilled in the art that various changes in form and detail may be made therein without departing from the spirit and scope of the invention.

Having thus described my invention, what I claim as new, and desire to secure by Letters Patent is:

1. A multicolor plasma display device comprising in combination, a pair of plate glass substrates, a conductor array formed on each of said substrates, said conductor arrays comprising a plurality of parallel conductors, said substrates being sealed with said conductor arrays in orthogonal relationship, the intersections of said conductors designating the discharge sites of said device, a dielectric coating over each of said conductor arrays, at least one of said dielectric coatings being composed of a layer of electroluminescent phosphor, and means responsive to the selective application of signals to said conductor arrays, said means comprising a layer of n-type semiconductor material selectively interposed between said conductors and said electroluminescent phosphor, for lowering the threshold voltage for electroluminescence of said plasma display device, thereby providing discharge and color light emission at selected discharge sites.

2. A device of the character claimed in claim 1 wherein said n-type semiconductor material is selectively applied to alternate conductors of the conductor array associated with said electroluminescent phosphor dielectric.

3. A device of the character claimed in claim 2 wherein said dielectric coatings over said conductor arrays are overcoated with a refractory layer to protect said dielectric from ion bombardment during discharge.

4. A device of the character claimed in claim 2 wherein each of said conductor arrays includes an electroluminescent phosphor and an n-type semiconductor material selectively interposed between said conductor arrays and said electroluminescent phosphor dielectrics.

5. A device of the character claimed in claim 4 wherein said electroluminescent phosphors have different color emitting characteristics to form a three color display.

6. A device of the character claimed in claim 5 wherein said n-type semiconductor is formed on alternate conductors in each of said conductor arrays.

7. A device of the character claimed in claim 6 wherein said electroluminescent phosphor dielectrics are overcoated with a refractory material having a high coefficient of secondary emission to lower the operating voltage of said device.

8. A device of the character claimed in claim 7 wherein said refractory material having a high coefficient of secondary emission is magnesium oxide.

* * * * *